US007566164B2

(12) United States Patent
Zarom

(10) Patent No.: US 7,566,164 B2
(45) Date of Patent: Jul. 28, 2009

(54) FLOATING AGITATION DEVICE TO HEAT AND FROTH MILK

(76) Inventor: Rony Zarom, 181 E. 65th St., New York, NY (US) 10021

( * ) Notice: Subject to any disclaimer, the term of this patent is extended or adjusted under 35 U.S.C. 154(b) by 368 days.

(21) Appl. No.: 11/637,248

(22) Filed: Dec. 12, 2006

(65) Prior Publication Data

US 2007/0133345 A1 Jun. 14, 2007

Related U.S. Application Data

(60) Provisional application No. 60/749,101, filed on Dec. 12, 2005.

(51) Int. Cl.
*B01F 7/16* (2006.01)
*B01F 15/06* (2006.01)

(52) U.S. Cl. ..... 366/146; 366/289

(58) Field of Classification Search ..... 366/65, 366/96–98, 262–265, 270, 273, 274, 249, 366/251, 280–282, 285, 286, 146, 289; 99/348; 261/120

See application file for complete search history.

(56) References Cited

U.S. PATENT DOCUMENTS 4,465,377 A * 8/1984 de Bruyne ..... 366/273
4,534,656 A * 8/1985 de Bruyne ..... 366/247
4,759,635 A * 7/1988 MacMichael et al. ..... 366/274
4,760,028 A * 7/1988 deBruyne et al. ..... 435/302.1
5,939,122 A * 8/1999 Brady ..... 426/474
6,283,625 B2 9/2001 Frankel et al.
6,796,705 B1 * 9/2004 Khubani ..... 366/197
7,178,979 B2 * 2/2007 Reusche et al. ..... 366/273
2007/0133345 A1 * 6/2007 Zarom ..... 366/146

FOREIGN PATENT DOCUMENTS

FR 2825082 A1 * 11/2002

* cited by examiner

*Primary Examiner*—Charles E Cooley
(74) *Attorney, Agent, or Firm*—Pearl Cohen Zedek Latzer, LLP

(57) ABSTRACT

The present invention provides an agitation device, comprising a motor for supplying rotational power, an outer shaft operatively connected to the motor, an extendible inner shaft positioned within the outer shaft and operatively connected thereto, an agitator positioned on the extendible inner shaft, and a floatation device positioned on the extendible inner shaft distal to the agitator from the motor for providing a buoyant force to the extendible inner shaft and the agitator for immersing the agitator at a predetermined level in a liquid. The present invention also provides a device for agitating and heating a liquid.

14 Claims, 5 Drawing Sheets

FLOATING AGITATION DEVICE TO HEAT AND FROTH MILK

This application claims the benefit of U.S. Provisional Application No. 60/749,101, filed Dec. 12, 2005.

FIELD OF THE INVENTION

This invention relates to heating and frothing of liquids, such as milk and the like.

BACKGROUND OF THE INVENTION

Conventional devices for heating and/or frothing a liquid, such as milk, may include a nozzle associated with a source of pressurized steam. When the nozzle is immersed in the liquid, the steam emerging from the nozzle causes both heating and frothing of the liquid. Unfortunately, this process has a number of disadvantages. For example, considerable skill may be required to properly execute this method; e.g., in order to efficiently froth milk, the user must learn how to correctly position the nozzle in a milk container, manually, and continually move the container relative to the nozzle, e.g., in a periodic circular motion. Additionally, it is very difficult to control the heating of the liquid by the steam, and as a result, the frothing efficiency may be reduced and/the temperature of the frothed liquid may not be ideal. Furthermore, steam cooled by the frothed liquid may significantly dilute the frothed liquid with water.

Devices for heating and frothing milk using a stirring or paddling mechanism as a frothing means, instead of steam, have been proposed; however, such devices have not been implemented commercially, e.g., due to inefficiency and/or over-complexity. A device described in U.S. Pat. No. 6,283,625 includes a jug-shaped liquid container associated with a heating unit. The frothing mechanism of this device includes upper and lower paddle groups within the container. During operation of the device, the lower and upper paddle groups may be rotated in opposite directions. This counter rotation mechanism requires a relatively complex transmission mechanism, which may be heavy and difficult to maintain. Additionally, this device may not efficiently froth milk if the device is not filled with an amount of milk suitable for the position of the paddles, and the frothing efficiency is expected to be further reduced during the frothing process as the level of un-frothed milk changes.

SUMMARY OF THE INVENTION

The present invention provides a device for efficiently heating and frothing a liquid, such as milk, by an automatic process. A device according to embodiments of the invention may include a floating agitation mechanism that is able to conform to the level of un-frothed liquid in the device, such that frothing generally occurs at a desired distance underneath from but close to a surface of the liquid being frothed. A heating mechanism associated with the device may heat the liquid during the frothing process. In some embodiments, the floating agitation mechanism includes a float and an agitator, both mounted to a variable-length driving shaft. The float may be adapted to float over un-frothed liquid while the agitator is immersed in the un-frothed liquid, at a desired depth underneath the surface of the un-frothed liquid. A motor may provide rotational power to drive the floating agitation mechanism via the variable-length drive shaft.

BRIEF DESCRIPTION OF THE DRAWINGS

The subject matter regarded as the invention is particularly pointed out and distinctly claimed in the concluding portion of the specification. The invention, however, both as to organization and method of operation, together with features and advantages thereof, may best be understood by reference to the following detailed description when read with the accompanied drawings in which:

DETAILED DESCRIPTION OF EMBODIMENTS OF THE INVENTION

In the following detailed description, numerous specific details are set forth in order to provide a thorough understanding of the invention. However, it will be understood by those of ordinary skill in the art that the invention may be practiced without these specific details. In other instances, well-known methods, procedures, components, units and/or circuits have not been described in detail so as not to obscure the invention.

Figure 1:
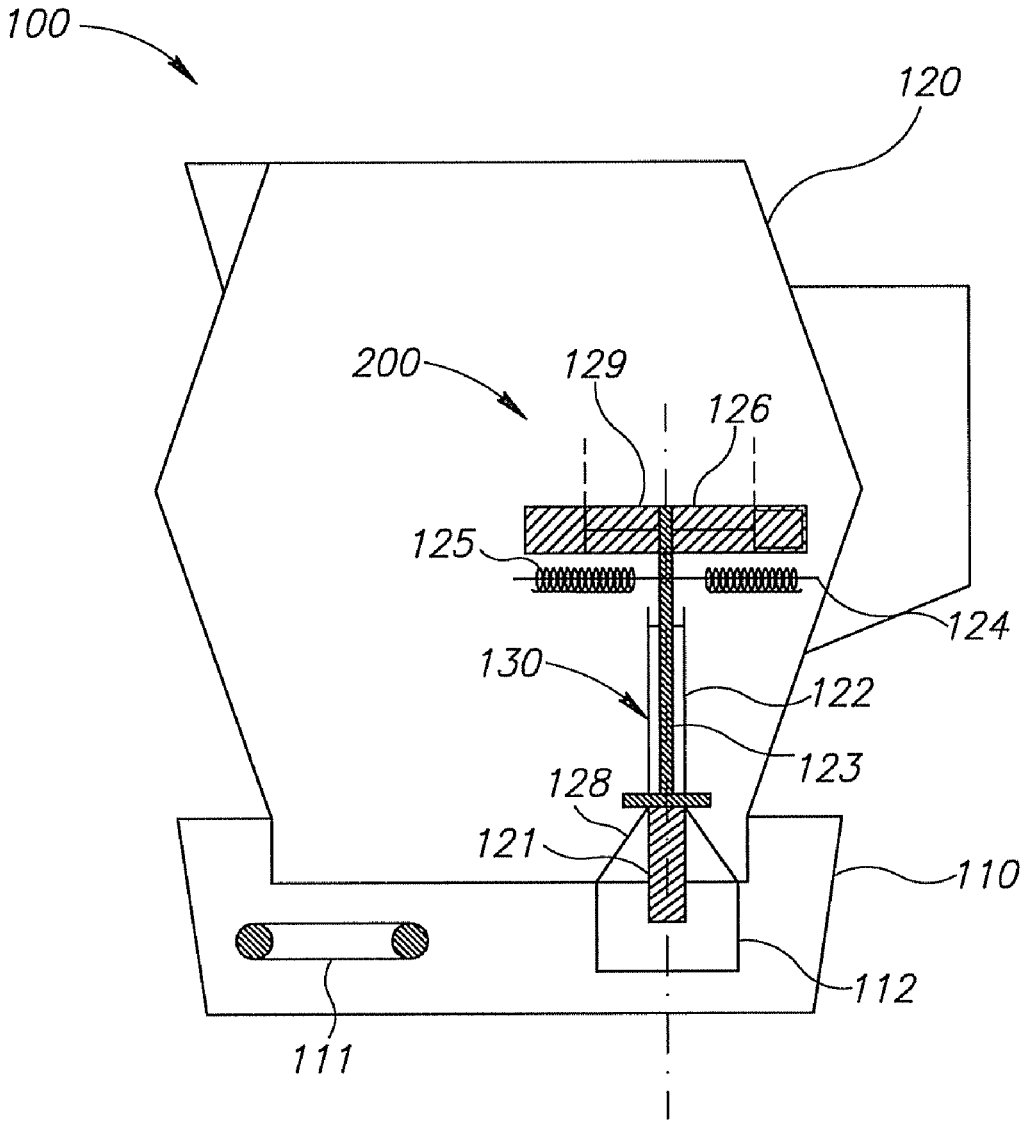
FIG. 1 is a schematic, cross-sectional, side view illustration of a milk frothing and heating device in accordance with a demonstrative embodiment of the invention.
Figure 2:
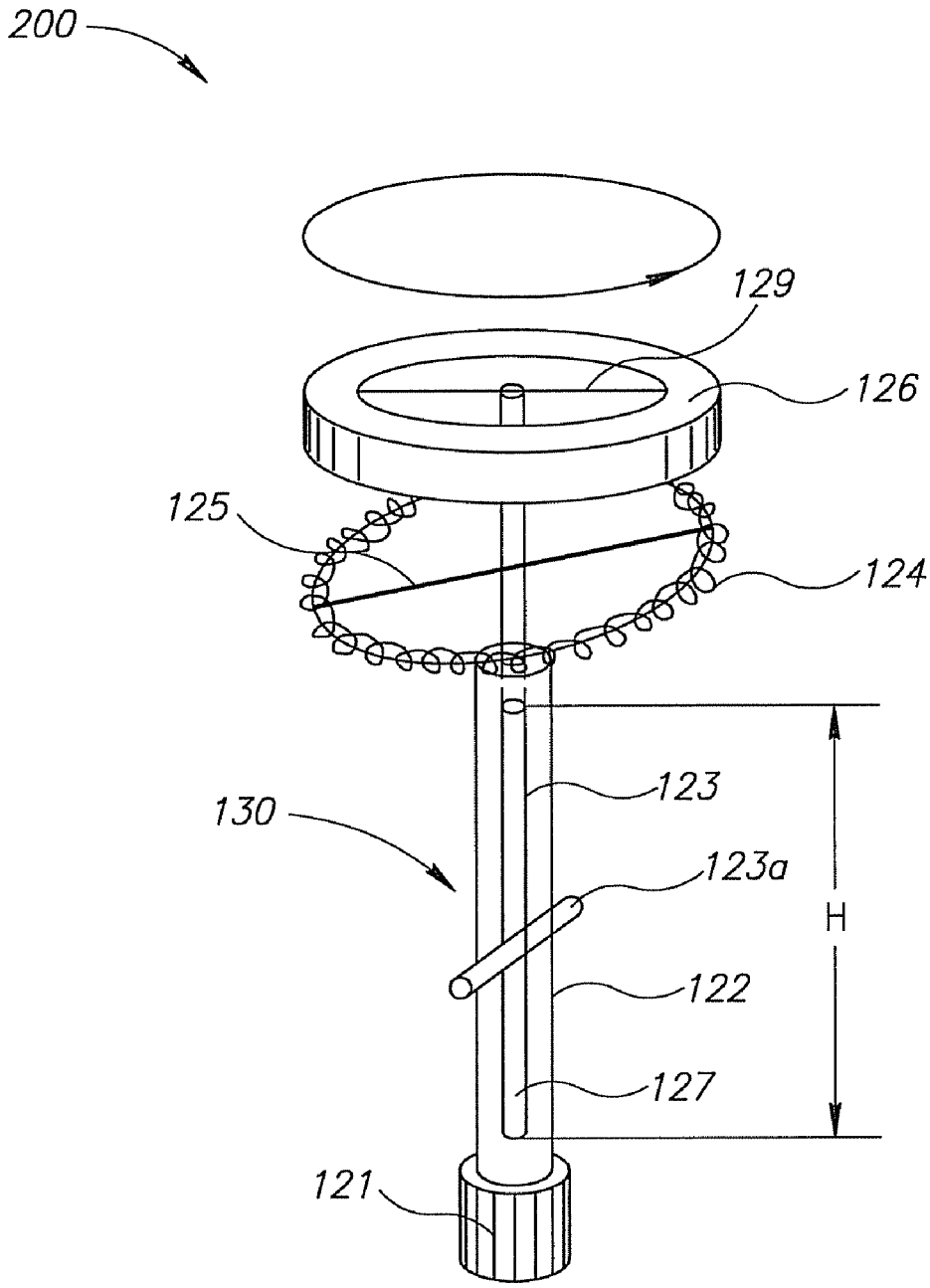
FIG. 2 is a schematic, isometric illustration of a floating agitation mechanism of the milk frothing and heating device of FIG. 1.

Reference is made to FIG. 1, which schematically illustrates a cross-sectional, side view of a milk frothing and heating device 100 in accordance with a demonstrative embodiment of the invention, and to FIG. 2, which is a schematic isometric illustration of a floating agitation mechanism 200 of the milk frothing and heating device 100 of FIG. 1.

In one demonstrative embodiment of the invention, milk frothing and heating device 100 may consist of a base portion 110 and a jug portion 120. Base portion 110 may contain one or more heating elements, for example, heating coils 111; and a motor 112. Electric power to heat coils 111 and to drive motor 112 may be provided by an external power supply (not shown), e.g., an electric grid outlet, using wires, cables and/or connectors (not shown) as are known in the art. Motor 112 may be connected to a gear 121 to transfer rotational motion from motor 112 to floating agitation mechanism 200, which is depicted in more detail in FIG. 2. Gear 121 may be housed in a housing 128, which may isolate gear 121 from the insides of jug portion 120.

Floating agitation mechanism 200 may be driven by a variable-length drive shaft 130, which may deliver rotational power from motor 112 upwards to components of mechanism 200 within jug portion 120, as described below. Variable-length shaft 130 may include an outer shaft 122, which may be mounted onto gear 121 to receive rotational power from motor 112, and an extendible inner shaft 123, which may rotate together with outer shaft 122 but may have a variable longitudinal position within shaft 122, as described in detail below. Mechanism 200 may further include an agitator 124, e.g., a coil or a mesh, which may be mounted near a top end of inner shaft 123, e.g., using a stopper 125; and a float 126, which may be mounted above agitator 124, e.g., on the top end of inner shaft 123, for example by pin 129. Float 126 may be adapted to maintain a desired vertical position of agitator 124 relative to a liquid to be frothed during operation of device 100, as described in detail below.

During operation of device 100, motor 112 may be activated to rotate gear 121, which in turn rotates outer driving shaft 122. As a consequence, extendable inner shaft 123, float 126 and agitator 124 may rotate as well, e.g., in the direction indicated by arrow R.

According to embodiments of the present invention, vertical displacement of extendible inner shaft 123 may be limited to a desired range. This may be achieved, for example, by confining extendible inner shaft 123 to move only within a slit 127 formed in outer shaft 122. The allowable vertical displacement range is determined by a length H of slit 127. A stopper pin 123*a* on extendible inner shaft 123, may be used to stop the vertical displacement of extendible inner shaft 123 at the upper and lower ends of slit 127.

Figure 3A:
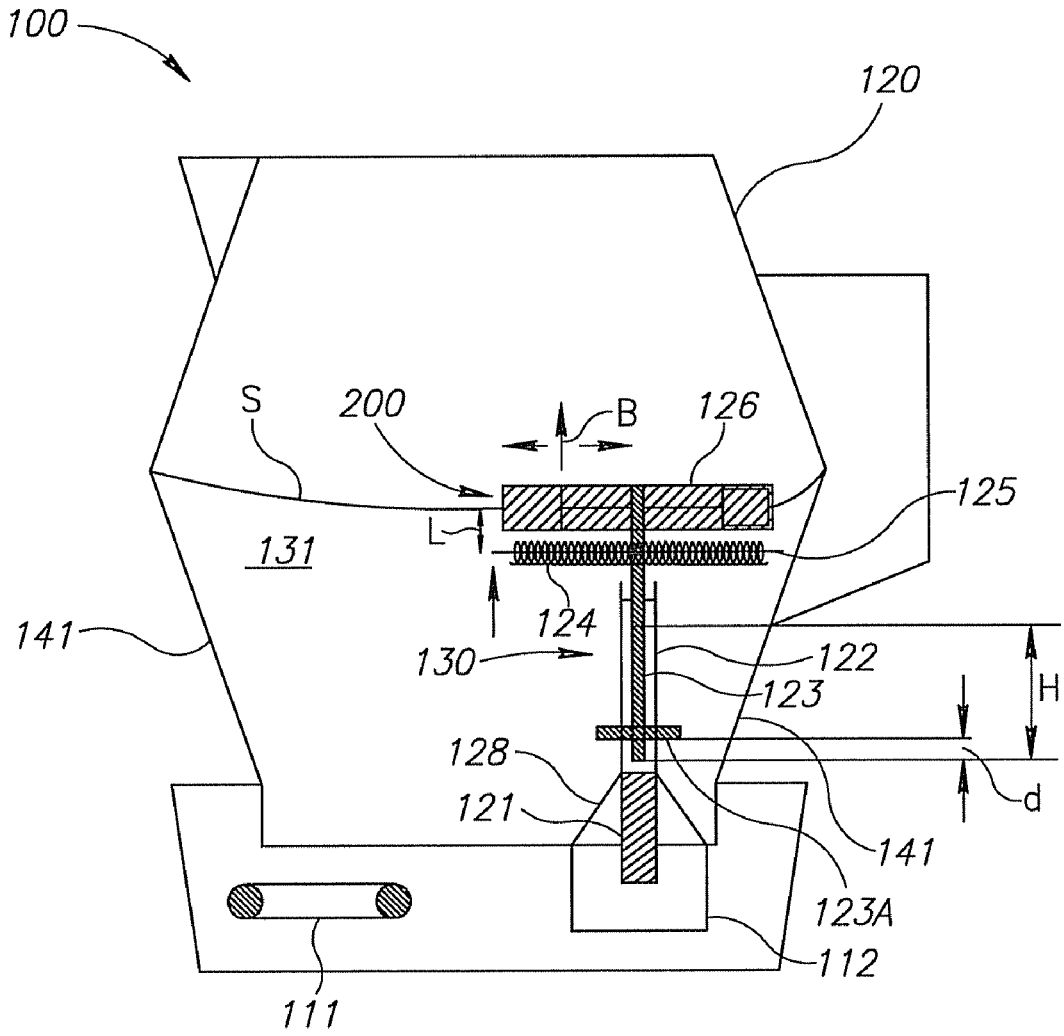
FIG. 3A is a schematic, cross-sectional, side view illustration of the device of FIG. 1 in a pre-activation stage, showing the mechanism of FIG. 2 floating in liquid to be heated and frothed, in accordance with demonstrative embodiments of the invention.

Reference is made to FIG. 3A, which schematically illustrates a cross-sectional side view of the device of FIG. 1 in pre-activation stage showing floating agitation mechanism 200 floating on a liquid 131, for example milk, in accordance with demonstrative embodiments of the invention.

In one demonstrative embodiment of the invention, during operation of device 100, float 126 may be partially immersed in liquid 131, whereas agitator 124 may be fully immersed in liquid 131, at a desired distance from a surface S of liquid 131. The extent of immersion of float 126, and as a consequence the extent of immersion of agitator 124, may depend on the buoyancy force (B) exerted by liquid 131 displaced by the floating agitation mechanism 200. In addition, the extent of immersion may also depend on the total weight (G) of inner shaft 123, agitator 124 and float 126. It will be appreciated by persons skilled in the art that mechanism 200 may be designed such that buoyancy B is larger than the weight G (B>G) by a desired amount, thereby to ensure a desired position L of agitator 124 and float 126 relative to surface S of un-frothed liquid 131. The design of mechanism 200 may take into account the specific weight and density of type of liquid, e.g., milk, that device 100 is intended to froth. It will be further appreciated by persons skilled in the art that a desired buoyancy of mechanism 200 will ensure that the level of agitator 124 below surface S may not depend on the amount of un-frothed liquid 131 in jug portion 120. For example, if the level of un-frothed milk surface S decreases by a distance ΔL, the level of agitator 124 may also decrease accordingly by ΔL together with float 126 and extendible inner shaft 123. Full immersion of agitator 124 and the substantially constant level of agitator 124 below the un-frothed liquid surface, S, may ensure that the milk contained in jug portion 120 is continuously frothed during operation of motor 112.

According to some embodiments of the invention, it may be desired to have at least some part of the agitator's 124 circumference close to a wall 141 of jug portion 120. This may ensure an improved agitation of liquid 131 and as a consequence a higher efficiency in the frothing process. According to other embodiments, floating agitation mechanism 200 may be located generally at the center of jug portion 120. The desired location of mechanism 200 within jug portion 120 may depend on the size and shape of agitator 124 and float 126.

Figure 3B:
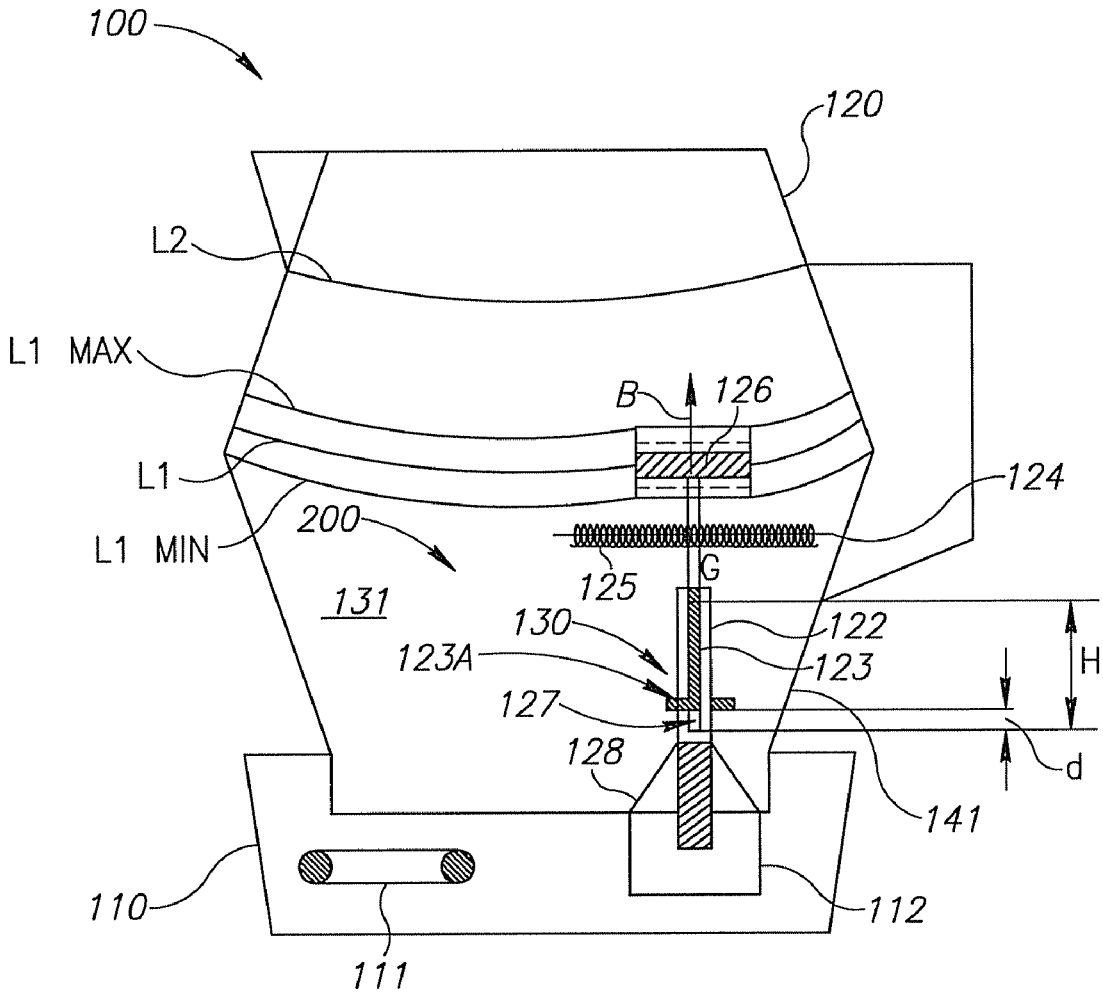
FIG. 3B is a schematic, cross-sectional, side view illustration of the device of FIG. 1 during operation showing agitation of liquid by the mechanism of FIG. 2, in accordance with a demonstrative embodiment of the invention.

Reference is now made to FIG. 3B, which schematically illustrates a cross-sectional side view of the device of FIG. 1 during operation, showing floating agitation mechanism 200 floatingly immersed in and agitating liquid 131, for example milk, in accordance with demonstrative embodiments of the invention.

As described above, activation of motor 112 may transfer rotational motion to gear 121, which in turn transfers rotational motion to floating agitation mechanism 200. The rotation direction, R, may be either clockwise or counterclockwise. As agitator 124 begins to agitate liquid 131, the agitation may generate air pockets within the liquid, due to a cavitation effect, as is known in the art. Continued agitation results in the formation of a frothed liquid layer, F, which has a lower density compared to the un-frothed liquid 131. A top level L2 of frothed layer F may be above a level L1 of agitated un-frothed liquid 131. By virtue of the continuous frothing process, the thickness of frothed layer F. i.e., L2-L1, may gradually increase until equilibrium level of L1 and L2 may be reached, at which point the frothing process is complete and motor 112 may be deactivated.

In some embodiments of the invention, during the agitation of liquid 131, heating coils 111 may be operated. The agitation of fluid 131 may spread the heat radiated from heating coils 111 more evenly within fluid 131. The heating process may continue until a desired temperature within fluid 131 is reached, which may be measured by a thermostat (not shown) of device 100.

It should be noted that, during rotation of agitator 124, turbulence of liquid 131 may cause float 126 to move slightly up and down according to the turbulent movement of surface L1. In one demonstrative embodiment of the invention, if agitator 124 rotates at a constant speed, the turbulence of liquid 131 may be periodic, such that level L1 may oscillate periodically between a maximum level, denoted $L1_{max}$ and a minimum level, denoted $L1_{min}$. It will be appreciated by persons skilled in the art that the oscillating longitudinal movement of mechanism 200 may improve the frothing efficiency, i.e., the amount of liquid, e.g., milk, that may be frothed by device 100 in a given time period. It should also be noted that the frothing of liquid 131 into foam layer F, which increases gradually until the frothing process is complete, causes a gradual decrease of level L1 of un-frothed liquid. It will be appreciated by persons skilled in the art that tie final ratio between frothed and un-frothed liquid may depend on the design of device 100. For example, a high frothing ratio may be achieved if the variable-length drive shaft 130 is designed to allow agitator 124 to move downward to a low position, e.g., close to base portion 110.

As level L1 is decreased, the location of agitator 124 becomes gradually lower. Hence, the overall vertical displacement over time of float 126, inner shaft 123 and agitator 124 is downwards. This process may continue until the thickness of layer F reaches a maximum (i.e., frothing is completed), until motor 112 is deactivated, or until the bottom of inner extendible shaft 123 reaches the bottom of outer shaft 122.

Figure 4:
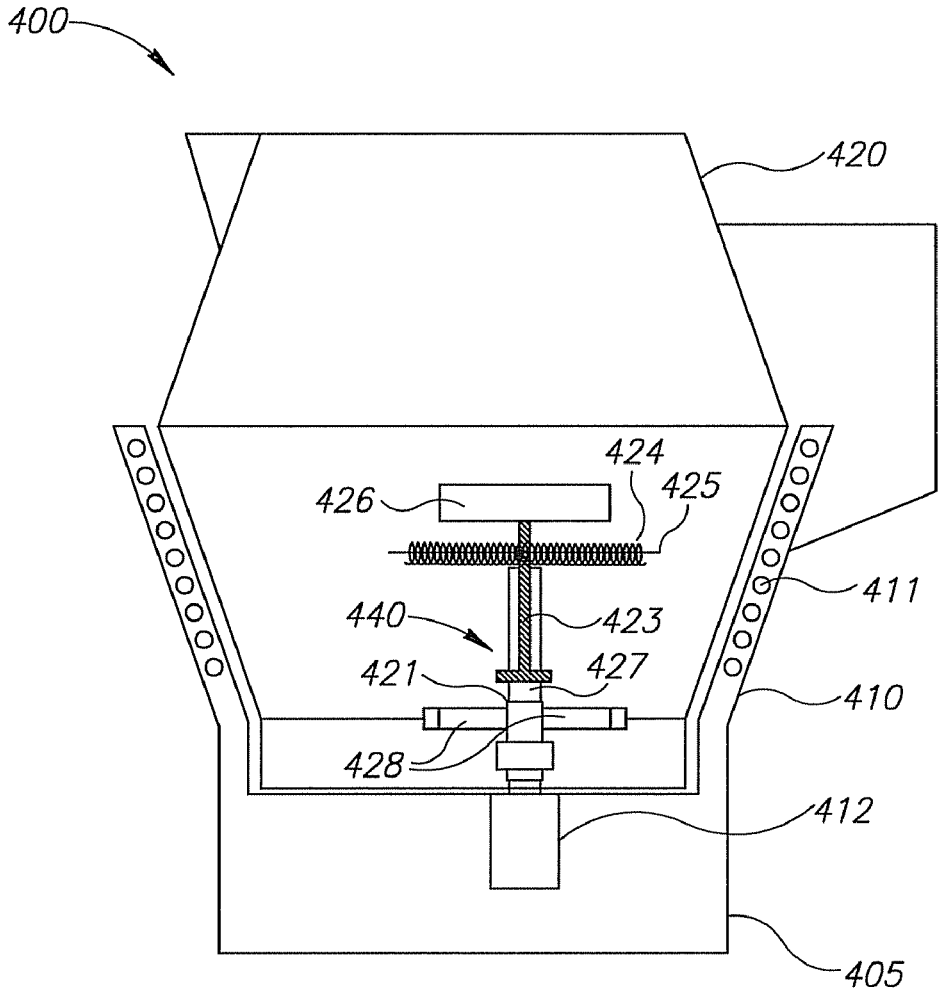
FIG. 4 is a schematic, cross-sectional, side view illustration of a milk frothing and heating device in accordance with another demonstrative embodiment of the invention.

Reference is made to FIG. 4, which schematically illustrates a cross-sectional side view of a liquid frothing and heating device 400 in accordance with another demonstrative embodiment of the invention.

In a demonstrative embodiment of FIG. 4, device 400 includes a base portion 410, which may house a motor 412; and a jug portion 420. Device 400 may further include a floating agitation mechanism 440, which may be similar in structure and operation to floating agitation mechanism 200 of FIG. 2. Floating agitation mechanism 440 may include float 426, agitator 424, stopper 425, inner shaft 423, outer shaft 427 and gear 421, operating substantially as described above with reference to FIGS. 1, 2, 3A and 3B. Device 400 may further include heating elements 411, e.g., heating coils, which may be disposed circumferentially within a sidewall 405 of base portion 410, e.g., from the bottom of base potion 410 and up to a recommended level of filing of liquid to be frothed. The external surface of side of sidewall 405 may be insulated from heat to avoid undesired heating outside of device 400. Device 400 may further include bottom heating elements 428 positioned in the bottom of base portion 410. Bottom heating elements 428 may be connected to gear 421 to receive rotational power from motor 412.

While certain features of the invention have been illustrated and described herein, many modifications, substitutions, changes, and equivalents may occur to those skilled in the art. It is, therefore, to be understood that tile appended claims are intended to cover all such modifications and changes as fall within the true spirit of the invention.

What is claimed is:

1. An agitation device, comprising:

a. a motor for supplying rotational power;

b. an outer shaft operatively connected to said motor;

c. an extendible inner shaft positioned within said outer shaft and operatively connected thereto;

d. an agitator positioned on said extendible inner shaft; and e. a floatation device positioned on said extendible inner shaft distal to said agitator from said motor for providing a buoyant force to said extendible inner shaft and said agitator for immersing said agitator at a predetermined level in a liquid.

2. The device of claim 1, wherein said outer shaft has a slit therein and said extendible inner shaft has a pin for extending into said slit.

3. The device of claim 2, further comprising a container for the liquid, wherein said container is adapted for receiving said floatation device said agitator, and said extendible inner shaft therein.

4. The device of claim 3, further comprising a heater for heating liquid positioned in said container.

5. The device of claim 4, wherein said container has a base and wherein said heater is positioned proximate said base of said container.

6. The device of claim 4, wherein said container has a wall and wherein said heater is positioned proximate said wall of said container.

7. The device of claim 6, further comprising a gear positioned between said motor and said outer shaft.

8. A device for agitating and heating a liquid, comprising:

a. a base;

b. a motor positioned in said base for supplying rotational power;

c. a vessel adapted for being supported by said base for containing the liquid;

d. an outer shaft for extending into said vessel and for operatively connecting to said motor;

e. an extendible inner shaft longitudinally positioned within said outer shaft and operatively connected thereto;

f. an agitator positioned on said extendible inner shaft;

g. a floatation device positioned on said extendible inner shaft distal to said agitator from said motor for providing a buoyant force to said extendible inner shaft and said agitator so that said agitator is immersed at a predetermined level in a liquid; and h. a heating element positioned in said base for heating said vessel.

9. The device of claim 8, wherein said vessel has a base and wherein said heating element is positioned for heating said base of said vessel.

10. The device of claim 8, wherein said vessel has a wall and wherein said heating element is positioned for heating said wall of said vessel.

11. The device of claim 10, wherein said outer shaft has a slit therein and said extendible inner shaft has a pin for extending into said slit.

12. The device of claim 10, wherein said agitator is positioned proximate said wall of said vessel.

13. The device of claim 8, wherein said agitator is adapted for oscillating longitudinal movement when rotated.

14. The device of claim 8, wherein said floatation device is adapted for positioning said agitator in a predetermined position relative to the surface of the liquid when the liquid is unfrothed.

* * * * *